US008641426B2

(12) United States Patent
Yang

(10) Patent No.: US 8,641,426 B2
(45) Date of Patent: Feb. 4, 2014

(54) COACH BOARD

(75) Inventor: Chui-Ching Yang, New Taipei (TW)

(73) Assignee: Chuang Yii Enterprise Co. Ltd., New Taipei (TW)

( * ) Notice: Subject to any disclaimer, the term of this patent is extended or adjusted under 35 U.S.C. 154(b) by 174 days.

(21) Appl. No.: 13/072,088

(22) Filed: Mar. 25, 2011

(65) Prior Publication Data

US 2012/0244515 A1 Sep. 27, 2012

(51) Int. Cl.
*B43L 1/00* (2006.01)

(52) U.S. Cl.
USPC ..... 434/408; 434/247

(58) Field of Classification Search
USPC ..... 375/229–236, 296, 346–350; 398/192–193; 434/247, 248, 251, 408, 434/413, 428, 429, 430
See application file for complete search history.

(56) References Cited

U.S. PATENT DOCUMENTS

| | | | | | |
|---|---|---|---|---|---|
| 3,560,092 | A * | 2/1971 | Coney | 434/248 |
| 3,685,170 | A * | 8/1972 | Fairleigh | 434/248 |
| 4,676,527 | A * | 6/1987 | Palmer | 281/31 |
| 4,968,258 | A * | 11/1990 | Kees | 434/370 |
| 5,163,845 | A * | 11/1992 | Blassingame | 434/408 |
| 5,263,866 | A * | 11/1993 | Campbell | 434/416 |
| 5,626,478 | A * | 5/1997 | Gatlin | 434/247 |
| 5,827,072 | A * | 10/1998 | Neufer et al. | 434/416 |
| 5,997,309 | A * | 12/1999 | Metheny et al. | 434/409 |
| 6,241,528 | B1 * | 6/2001 | Myers | 434/408 |
| 6,379,156 | B1 * | 4/2002 | Laravea et al. | 434/247 |
| 6,439,572 | B1 * | 8/2002 | Bowen | 273/239 |
| 6,464,507 | B1 * | 10/2002 | Bailey | 434/247 |
| 6,866,516 | B2 * | 3/2005 | Smith et al. | 434/408 |
| 2002/0080883 | A1 * | 6/2002 | Tamura et al. | 375/257 |
| 2005/0289204 | A1 * | 12/2005 | Tellado et al. | 708/300 |

* cited by examiner

*Primary Examiner* — Kurt Fernstrom
(74) *Attorney, Agent, or Firm* — Apex Juris, pllc; Tracy M. Heims

(57) ABSTRACT

A coach board has a mounting board, a transparent film, an attractive board and a box. The transparent film is connected to the mounting board so as to form an interlayer space between the transparent film and the mounting board. The attractive board is removably inserted into the interlayer space between the transparent film and the mounting board and has a court layer. The court layer is attached to the attractive board, is visible via the transparent film and is protected by the transparent film. The box is mounted on the mounting board and receives multiple magnets inside. Therefore, a coach can instruct tactics to players easily by putting the magnets on the transparent film corresponding to the court layer of the attractive board.

8 Claims, 5 Drawing Sheets

COACH BOARD

BACKGROUND OF THE INVENTION

1. Field of the Invention

The present invention relates to a coach board, and more particularly to a coach board that allows a coach to instruct tactics easily.

2. Description of the Prior Arts

With reference to FIG. 5, a conventional coach board comprises a mounting board 60, a transparent membrane 70 and a bag 80. The mounting board 60 is magnetic and has a court layer 61. The court layer 61 is printed on the mounting board 60 and may be a basketball court layer, a volleyball court layer or the like. The transparent membrane 70 is mounted on the mounting board 60 to cover over the court layer 61 to make the court layer 61 visible through the transparent membrane 70 and provide a protection effect to the court layer 61. The bag 80 is mounted on the mounting board 60 and holds multiple magnets inside. The magnets can be put on the transparent membrane 70 at positions corresponding to the court layer 61 of the mounting board 60 and the magnets can be securely attracted and attached to the magnetic mounting board 60. When instructing tactics to players, a coach can move the magnets and change the positions of the magnets. The magnets correspond respectively to the players, that is, a position of each magnet on the court layer 61 means a position of one player on a real court. Therefore, the players can understand and successfully perform the tactics.

However, the transparent membrane 70 is connected to the mounting board 60 only at a perimeter edge. If air inadvertently enters between the transparent membrane 70 and mounting board 60 during a connecting process, a surface of the transparent membrane 70 will wrinkle and appear uneven, the court layer 61 is unable to show via the transparent membrane 70 clearly and the magnets are unable to be attracted to the mounting board 60 securely. Besides, the court layer 61 printed on the mounting board 60 is unchangeable, so the conventional coach broad can only be used in a specific kind of ball game. Multiple coach broads must be prepared if a user plays many different kinds of ball games.

To overcome the shortcomings, the present invention provides a coach board to mitigate or obviate the aforementioned problems.

SUMMARY OF THE INVENTION

The main object of the present invention is to provide a coach board that functions in a stable yet flexible manner for application.

To achieve the foregoing objective, the coach board in accordance with the present invention comprises a mounting board, a transparent film, an attractive board and a box. The transparent film is connected to the mounting board so as to form an interlayer space between the transparent film and the mounting board. The attractive board is removably inserted into the interlayer space between the transparent film and the mounting board and has a court layer. The court layer is attached to the attractive board, is showed via the transparent film and is protected by the transparent film. The box is mounted on the mounting board and receives multiple magnets inside. Therefore, a coach can instruct tactics to players easily by putting the magnets on the transparent film corresponding to the court layer of the attractive board.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
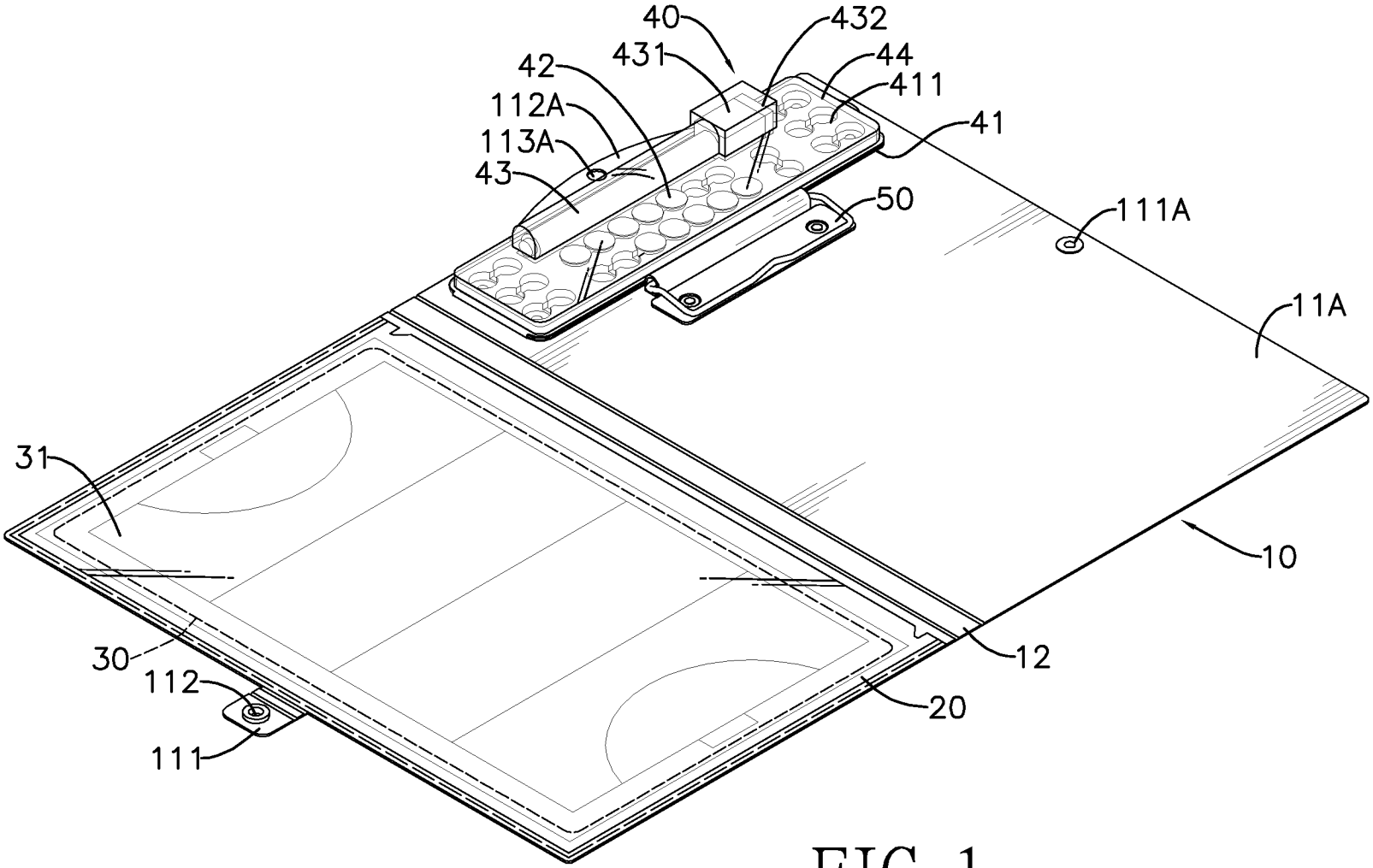
FIG. 1 is a perspective view of a coach board in accordance with the present invention.
Figure 2:
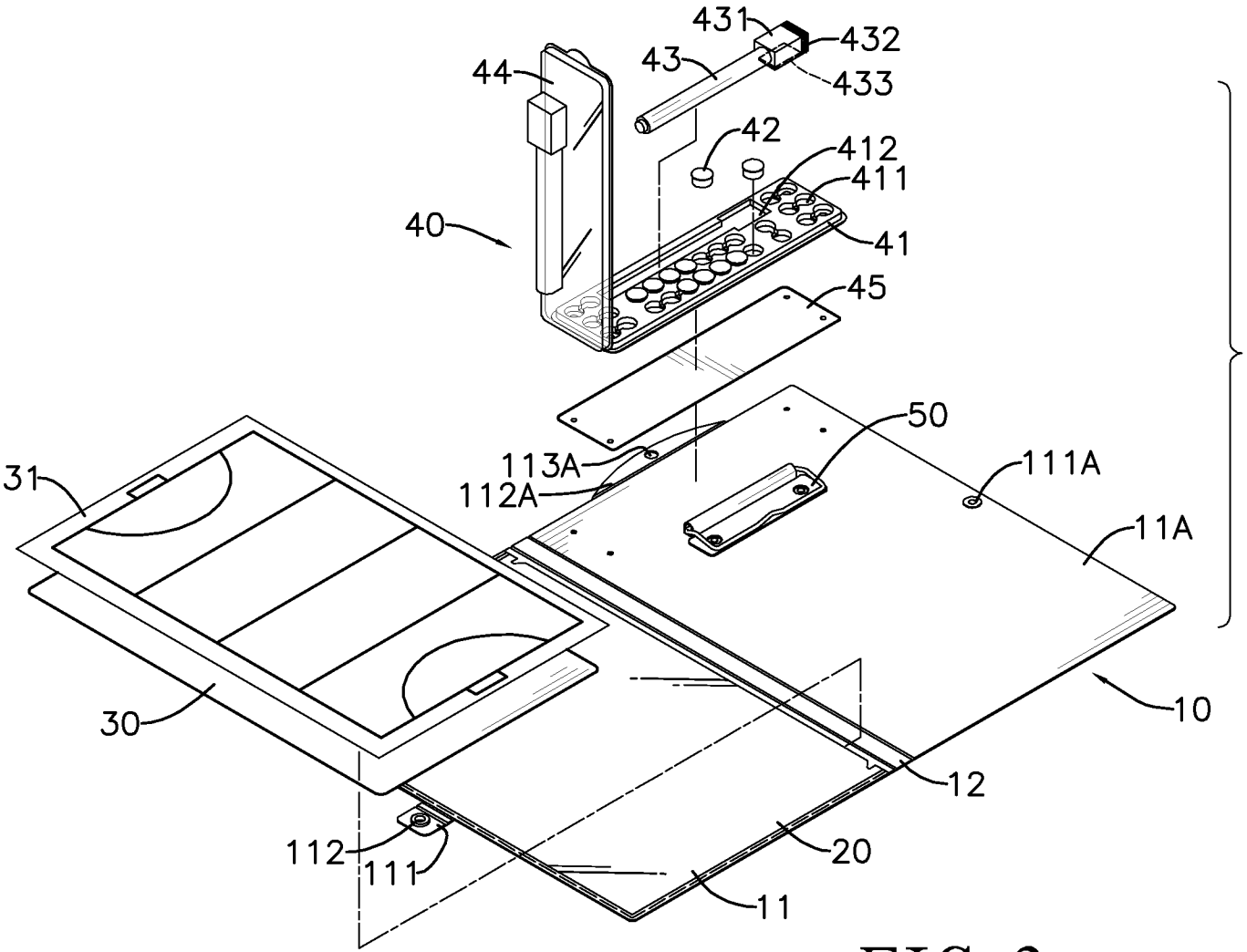
FIG. 2 is an exploded perspective view of the coach board in FIG. 1.

With reference to FIGS. 1 and 2, a coach board in accordance with the present invention comprises a mounting board 10, a transparent film 20, an attractive board 30, a box 40 and a clamping apparatus 50.

Figure 3:
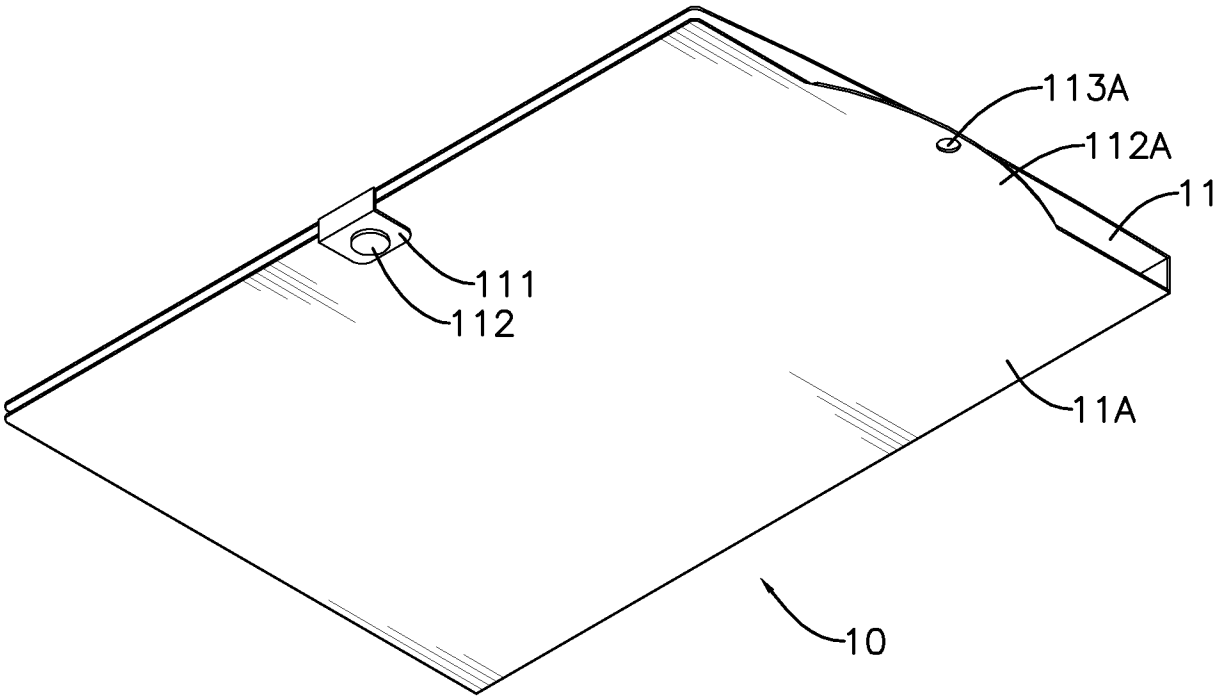
FIG. 3 is a perspective view of the coach board in FIG. 1, showing the coach board being folded up.

The mounting board 10 is foldable and has an upper board 11, a lower board 11A and a ridge board 12. The upper board 11 has an outer edge, an inner side, an internal surface, a buckle piece 111 and a female buckle 112. The buckle piece 111 is mounted on and protrudes from the outer edge of the upper board 11. The female buckle 112 is mounted on the buckle piece 111. The lower board 11A has an outer edge, an inner edge, a top edge, an internal surface, a male buckle 111A, a hanging piece 112A and a hole 113A. The male buckle 111A is mounted on the lower board 11A near the outer edge of the lower board 11A and corresponds to the female buckle 112 of the upper board 11. The hanging piece 112A is mounted on and protrudes from the top edge of the lower board 11A. The hole 113A is formed through the hanging piece 112A and is used for hanging the coach board on another object. The ridge board 12 is connected between the inner edges of the upper board 11 and lower board 11A. With further reference to FIG. 3, when the upper board 11 and lower board 11A are folded up, the buckle piece 111 can be bended to make the female buckle 112 engage the male buckle 111A. Accordingly, an expanded area of the mounting board 10 is reduced so to store the mounting board 10 is convenient.

The transparent film 20 with a flat surface is made of polyethylene (PE), polyvinyl chloride (PVC), polyethylene terephthalate (PET), polypropylene (PP) or the like. The transparent film 20 is connected to the internal surface of the upper board 11 of the mounting board 10 so as to form an interlayer space between the transparent film 20 and the upper board 11 of the mounting board 10. In a preferred embodiment, the transparent film 20 is rectangular and has four edges. Three of the edges of the transparent film 20 are adhered to the upper board 11 of the mounting board 10 by high frequency, ultrasonic waves or other hot pressing methods. An entrance is formed between the other edge of the transparent film 20 and the upper board 11 of the mounting board 10.

Figure 4:
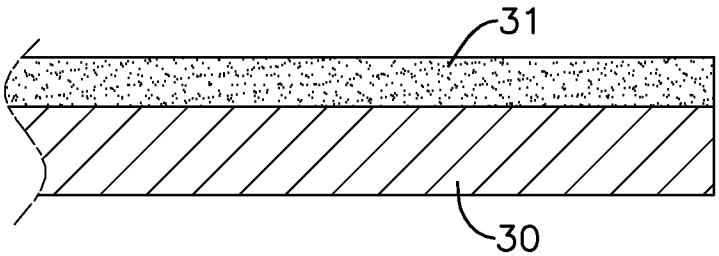
FIG. 4 is a partially enlarged side view in partial section of another embodiment of an attractive board of a coach board in accordance with the present invention.
Figure 5:
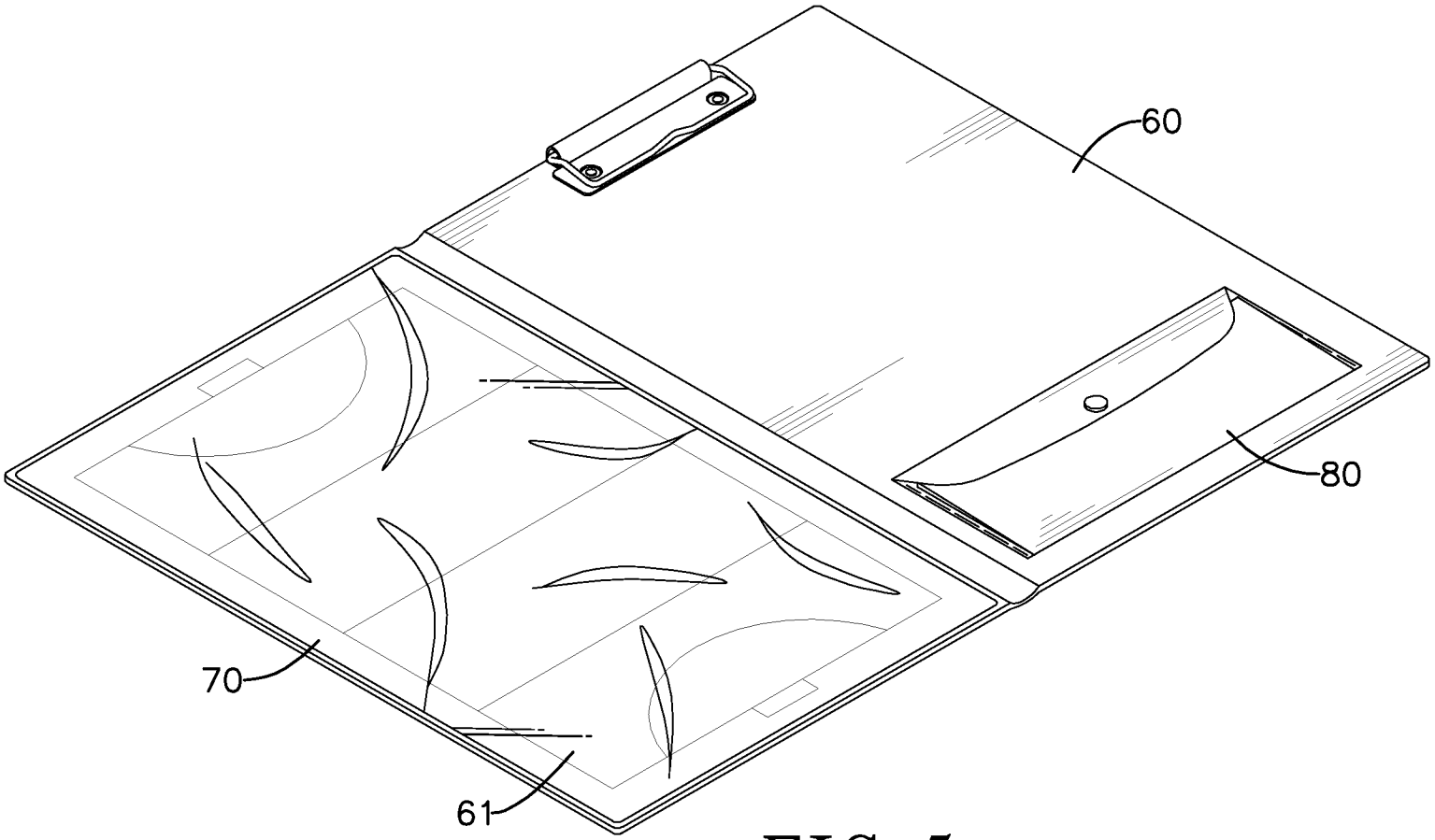
FIG. 5 PRIOR ART
FIG. 5 is a perspective view of a conventional coach board in accordance with the prior art.

The attractive board 30 is made of magnet or iron, is removably inserted into the interlayer space between the transparent film 20 and the upper board 11 of the mounting board 10 and has an upper surface and a court layer 31. The court layer 31 is attached to the upper surface of the attractive board 30, is visible via the transparent film 20 and is protected by the transparent film 20. The court layer 31 and the attractive board 30 may be two individual components as shown in FIG. 2 or the court layer 31 is printed on the upper surface of the attractive board 30 to form a single component as shown in FIG. 4. Besides, the four edges of the transparent film 20 may adhere to the upper board 11 of the mounting board 10 to allow the attractive board 30 to be inserted securely inside the interlayer space between the transparent film 20 and the upper board 11 of the mounting board 10.

The box 40 is mounted on the internal surface of the lower board 11A of the mounting board 10 and has a base 41, multiple magnets 42, a water-based pen 43, a cover 44 and an attractive piece 45. The base 41 has an upper surface, a lower surface, multiple magnet recesses 411 and a pen recess 412. The magnet recesses 411 and the pen recess 412 are formed in the upper surface of the base 41. Each magnet recess 411 receives one of the magnets 42 inside. The pen recess 412 receives the water-based pen 43 inside. The water-based pen 43 has a pen cap 431, an eraser 432 and a magnet part 433. The pen cap 431 has a distal end and a lower surface. The eraser 432 is attached to the distal end of the pen cap 431. The magnet part 433 is attached to the lower surface of the pen cap 431. The cover 44 is connected to and covers the base 41. The attractive piece 45 is made of magnet or iron and is mounted on the lower surface of the base 41. The magnets 42 and the magnet part 433 of the water-based pen 43 are attracted to the attractive piece 45 so the magnets 42 and the water-based pen 43 will be positioned inside the box 40 stably.

The clamping apparatus 50 is mounted on the internal surface of the lower board 11A of the mounting board 10, is adjacent to the box 40 and is used for clamping papers.

When instructing tactics to players, a coach can put the magnets 42 on the transparent film 20 and the magnets 42 will be attracted to the attractive board 30. Also the coach can use the water-based pen 43 to write on the transparent film 20 and writing on the transparent film 20 can be erased by the eraser 432 of the pen cap 321 easily.

The coach board in accordance with the present invention provides the transparent film 20 with a flat surface so the court layer 31 of the attractive board 30 can be showed clearly via the transparent film 20 and the magnets 42 can be attracted to the attractive board 30 securely. Besides, the attractive board 30 with the court layer 31 can be taken out or inserted through the entrance between the transparent film 20 and the upper board 11 of the mounting board 10. Therefore, a user can change different court layers 31 easily when playing different kinds of ball games.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A coach board comprising:

a mounting board;

a transparent film with a flat surface connected to the mounting board so as to form an interlayer between the transparent film and the mounting board;

an attractive board mounted in the interlayer between the transparent film and the mounting board and having an upper surface and a court layer attached to the upper surface of the attractive board; and a box mounted on the mounting board and receiving multiple magnets inside; wherein the court layer and the attractive board are two individual components.

2. The coach board as claimed in claim 1, wherein the transparent film is rectangle and has four edges, three of the edges are adhered to the mounting board and an entrance is formed between the other edge and the mounting board.

3. The coach board as claimed in claim 1, wherein the mounting board is foldable and has an upper board having an internal surface to which the transparent film is connected; and a lower board having an internal surface on which the box is mounted.

4. The coach board as claimed in claim 2, wherein the mounting board is foldable and has an upper board having an internal surface to which the transparent film is connected; and a lower board having an internal surface on which the box is mounted.

5. The coach board as claimed in claim 3, wherein the upper board of the mounting board further has an outer edge;

an inner edge;

a buckle piece mounted on and protruding from the outer edge of the upper board; and a female buckle mounted on the buckle piece; and the lower board of the mounting board further has an outer edge;

an inner edge; and a male buckle mounted on the lower board near the outer edge of the lower board and corresponding to the female buckle of the upper board; and the mounting board further has a ridge board connected between the inner edges of the upper board and lower board.

6. A coach board comprising:

a mounting board;

a transparent film with a flat surface connected to the mounting board so as to form an interlayer between the transparent film and the mounting board;

an attractive board mounted in the interlayer between the transparent film and the mounting board and having an upper surface and a court layer attached to the upper surface of the attractive board; and a box mounted on the mounting board and receiving multiple magnets inside;

wherein the transparent film is rectangle and has four edges, three of the edges are adhered to the mounting board and an entrance is formed between the other edge and the mounting board;

wherein the mounting board is foldable and has an upper board having an internal surface to which the transparent film is connected, and a lower board having an internal surface on which the box is mounted;

wherein the upper board of the mounting board further has an outer edge, an inner edge, a buckle piece mounted on and protruding from the outer edge of the upper board, and a female buckle mounted on the buckle piece; and wherein the lower board of the mounting board further has an outer edge, an inner edge, and a male buckle mounted on the lower board near the outer edge of the lower board and corresponding to the female buckle of the upper board;

wherein the mounting board further has a ridge board connected between the inner edges of the upper board and lower board;

wherein the lower board of the mounting board further has a top edge, a hanging piece mounted on and protruding from the top edge of the lower board, and a hole formed through the hanging piece;

wherein the box further has a base having an upper surface;

a lower surface; and multiple magnet recesses formed in the upper surface of the base and each magnet recess receiving one of the magnets inside;

a cover connected to and covering the base; and an attractive piece mounted on the lower surface of the base.

7. The coach board as claimed in claim 6, wherein the box further has a pen recess formed in the upper surface of the base of the box and receiving a water-based pen inside, and the water-based pen has a pen cap having a distal end and a lower surface;

an eraser attached to the distal end of the pen cap; and a magnet part attached to the lower surface of the pen cap.

8. The coach board as claimed in claim 7 further having a clamping apparatus mounted on the internal surface of the lower board of the mounting board adjacent to the box.

* * * * *